US006358298B1

(12) United States Patent
Gagné et al.

(10) Patent No.: US 6,358,298 B1
(45) Date of Patent: Mar. 19, 2002

(54) IRON-GRAPHITE COMPOSITE POWDERS AND SINTERED ARTICLES PRODUCED THEREFROM

(75) Inventors: Martin Gagné, Tracy; Paolo Filippelli, Delson; Alain Trudel, Sorel, all of (CA)

(73) Assignee: Quebec Metal Powders Limited (CA)

( * ) Notice: Subject to any disclaimer, the term of this patent is extended or adjusted under 35 U.S.C. 154(b) by 0 days.

(21) Appl. No.: 09/609,115

(22) Filed: Jun. 30, 2000

(51) Int. Cl.[7] ..... C22C 33/02

(52) U.S. Cl. ..... 75/243; 75/255; 75/338; 419/11; 419/31

(58) Field of Search ..... 75/243, 338, 255; 419/11, 31; 148/513

(56) References Cited

U.S. PATENT DOCUMENTS

| | | | | |
|---|---|---|---|---|
| 1,830,630 | A | 11/1931 | Valentine | |
| 2,301,805 | A | 11/1942 | Harder | 75/22 |
| 3,600,238 | A | 8/1971 | Ravenel | 148/3 |
| 4,042,385 | A | 8/1977 | Miyake et al. | 75/224 |
| 4,266,974 | A | 5/1981 | Nitta et al. | 75/251 |
| 4,388,114 | A | 6/1983 | Suganuma et al. | 75/243 |
| 4,492,671 | A | 1/1985 | Ruano et al. | 419/48 |
| 4,504,312 | A | 3/1985 | Oaku et al. | 75/244 |
| 4,556,533 | A | 12/1985 | Oaku et al. | 419/11 |
| 4,964,908 | A | 10/1990 | Greetham | 75/241 |
| 4,970,049 | A | 11/1990 | Baker et al. | 419/11 |
| 5,007,956 | A | 4/1991 | Fujita et al. | 75/238 |
| 5,240,672 | A | 8/1993 | Yang | 419/47 |
| 5,372,777 | A | 12/1994 | Yang | 419/47 |
| 5,549,151 | A | 8/1996 | Yang | 419/97 |
| 5,628,045 | A | 5/1997 | Lindner et al. | 419/25 |
| 5,656,787 | A | 8/1997 | Shivanath et al. | 75/228 |
| 5,777,247 | A | 7/1998 | Garg et al. | 75/246 |
| 5,856,625 | A | 1/1999 | Saunders et al. | 75/236 |
| 5,997,805 | A | 12/1999 | Lawcock et al. | 419/28 |
| 6,019,937 | A | 2/2000 | Shivanath et al. | 419/14 |

FOREIGN PATENT DOCUMENTS

| | | |
|---|---|---|
| FR | 2 524 833 | 10/1983 |
| JP | 51-123714 | 10/1976 |
| JP | 53-102208 | 9/1978 |
| JP | 54-126623 | 10/1979 |
| JP | 56-169754 | 12/1981 |
| JP | 57-82451 | 5/1982 |
| JP | 57-089461 | 6/1982 |
| JP | 57-158353 | 9/1982 |
| JP | 58-19403 | 2/1983 |
| JP | 58-073750 | 5/1983 |
| JP | 58-091152 | 5/1983 |
| JP | 58-126955 | 7/1983 |
| JP | 58-126958 | 7/1983 |
| JP | 58-126959 | 7/1983 |
| JP | 58-144450 | 8/1983 |
| JP | 58-164714 | 9/1983 |
| JP | 59-162247 | 9/1984 |
| JP | 59-211501 | 11/1984 |
| JP | 60-208453 | 10/1985 |
| JP | 60-262938 | 12/1985 |
| JP | 62-1806 | 1/1987 |
| JP | 2-15150 | 1/1990 |
| JP | 11-256277 | 9/1992 |
| JP | 5-9501 | 1/1993 |
| JP | 6-41674 | 2/1994 |
| JP | 6-170584 | 6/1994 |
| JP | 6-228603 | 8/1994 |
| JP | 6-322470 | 11/1994 |
| JP | 7-166300 | 6/1995 |
| JP | 7-179997 | 7/1995 |
| JP | 9-195006 | 7/1997 |
| JP | 10-130773 | 5/1998 |
| JP | 11-12602 | 1/1999 |
| WO | WO85/00835 | 2/1985 |
| WO | WO99/50010 | 10/1999 |

OTHER PUBLICATIONS

Uenosono et al., Advances in Powder Metallurgy & Particulate Materials No. 6 (1997) pp. 23–30.

Ovecoglu et al., The International Journal of Powder Metallurgy, vol. 34, No. 6 (1998) pp. 47–56.

Yang et al., (International Conference on Powder Metallurgy and Particulate Materials), "Graphite Formation in Boron-Containing P/M Ferrous Alloys and its Self–Lubricant Effects" (Jun. 1998).

*Primary Examiner*—Ngoclan Mai
(74) *Attorney, Agent, or Firm*—Fitzpatrick, Cella, Harper & Scinto

(57) ABSTRACT

An iron-graphite composite powder having a microstructure comprising carbon clusters embedded in a ferrous matrix is disclosed. Also disclosed is a process for preparing the iron-graphite composite powder, a process for preparing sintered articles from this composite powder and the sintered articles prepared thereby.

72 Claims, 4 Drawing Sheets

IRON-GRAPHITE COMPOSITE POWDERS AND SINTERED ARTICLES PRODUCED THEREFROM

BACKGROUND OF THE INVENTION

1. Field of the Invention

This invention relates to a metal powder which is used for the production of structural parts having superior mechanical properties and machinability. In particular, this invention relates to iron-graphite composite powders, the process for the preparation thereof and the process for forming parts using powder metallurgy manufacturing technology therefrom.

2. Related Background Art

Conventionally, metal parts may be manufactured by casting a liquid metal or forming or machining a solid into a specific shape or form. Malleable iron is a particularly useful material for the manufacture of metal parts because of its superior machinability, toughness, ductility, corrosion resistance, strength, magnetic properties and uniformity. These properties arise from the metallographic microstructure of the iron, which comprises carbon clusters embedded in a ferrous matrix. However, malleable iron is a cast iron.

Due to the growing demand for inexpensive, light weight machine parts, powder metallurgy (P/M) manufacturing technology is replacing conventional manufacturing practices. In powder metallurgy, a raw metal powder material is press molded to produce a green compact, which is subjected to sintering. The sintered body may be further subjected to coining, forging, heat-treatment, and occasionally cutting or machining to produce the final metal product. For example, U.S. Pat. No. 5,628,045 discloses a process for forming sintered parts having an austenitic and/or bainitic matrix by selective cooling (additional heat treatment) of a sintered article. Accordingly, the raw metal powder material used in this process must possess several important properties. The raw metal material must be suitable for press molding, and therefore must possess acceptable hardness and compressibility. The hardness of a powder will have a direct effect on its compressibility—a lower hardness will result in a superior compressibility. In addition, the solid metal products produced from the raw metal material should advantageously possess mechanical strength, toughness and machinability. Thus the raw metal material used to prepare these products must also possess good heat-treatment properties, e.g., sinterability and hardenability. Several workers have attempted to prepare a powder, useful in powder metallurgy manufacturing, that would also provide sintered articles having the high graphite content and microstructure of malleable iron. For example, Yang (International Conference on Powder Metallurgy and Particulate Materials, presented Jun. 1, 1998) disclosed a sintered steel prepared by graphitization of a green compact composed of a boron and sulfur containing P/M ferrous alloy. The sintered steel possessed a ferritic matrix, wherein the graphite was precipitated in the pores of the sintered article. The graphite was a so-called "free-form" graphite, because the shape of the graphite produced was dependent upon the shape of the pores in which it was precipitated.

Uenosono (Proceedings of the International Conference on Powder Metallurgy and Particulate Materials, Jun. 29–Jul. 2, 1997, Chicago, Ill.) disclosed a sintered steel, similar to that of Yang, also containing boron and sulfur and having graphite deposited in the pore sites.

Shivanath (U.S. Pat. No. 5,656,787) disclosed the use of a carbon/iron blend in the formation of sintered articles. In this case, the blend is comprised of comparatively small particles of carbon dispersed within the voids formed by the comparatively larger ferro alloy particles. Ovecoglu (Intl. J. Powder Metallurgy, 1998) discloses attrition milling of iron powder and graphite powder to form iron-carbon powder composite alloys. Milling of the iron-graphite powder mixture for extended periods of time results in the gradual disappearance of graphite. X-ray diffraction spectra of the powder obtained after milling for 20 hours indicates that the powder particles contain only $\alpha$-Fe.

These methods, however, do not produce P/M powders which possess the metallographic microstructure or the desirable properties of malleable iron. Moreover, these methods do not provide for the efficient production of such powders in quantity. Accordingly, it would be desirable to provide an iron-graphite composite powder that provides the advantages of malleable iron and that may be used to produce sintered articles using powder metallurgy manufacturing technology.

SUMMARY OF THE INVENTION

This invention relates to a novel iron-graphite composite powder having a microstructure comprising carbon clusters in a ferrous matrix. Another embodiment of this invention relates to a process of preparing this iron-graphite composite powder comprising the steps of:

(a) atomizing a liquid iron to form an atomized iron powder;

(b) heating the atomized iron powder to a first stage graphitization temperature; and (c) cooling the powder from the first stage graphitization temperature to a second stage graphitization temperature.

This invention also relates to a sintered article prepared by the process of sintering the iron-graphite composite powder of this invention. In another embodiment, this invention relates to sintered articles, produced from the iron-graphite composite powder of this invention, which have been subjected to post-sintering treatments.

DETAILED DESCRIPTION OF THE INVENTION

Figure 1:
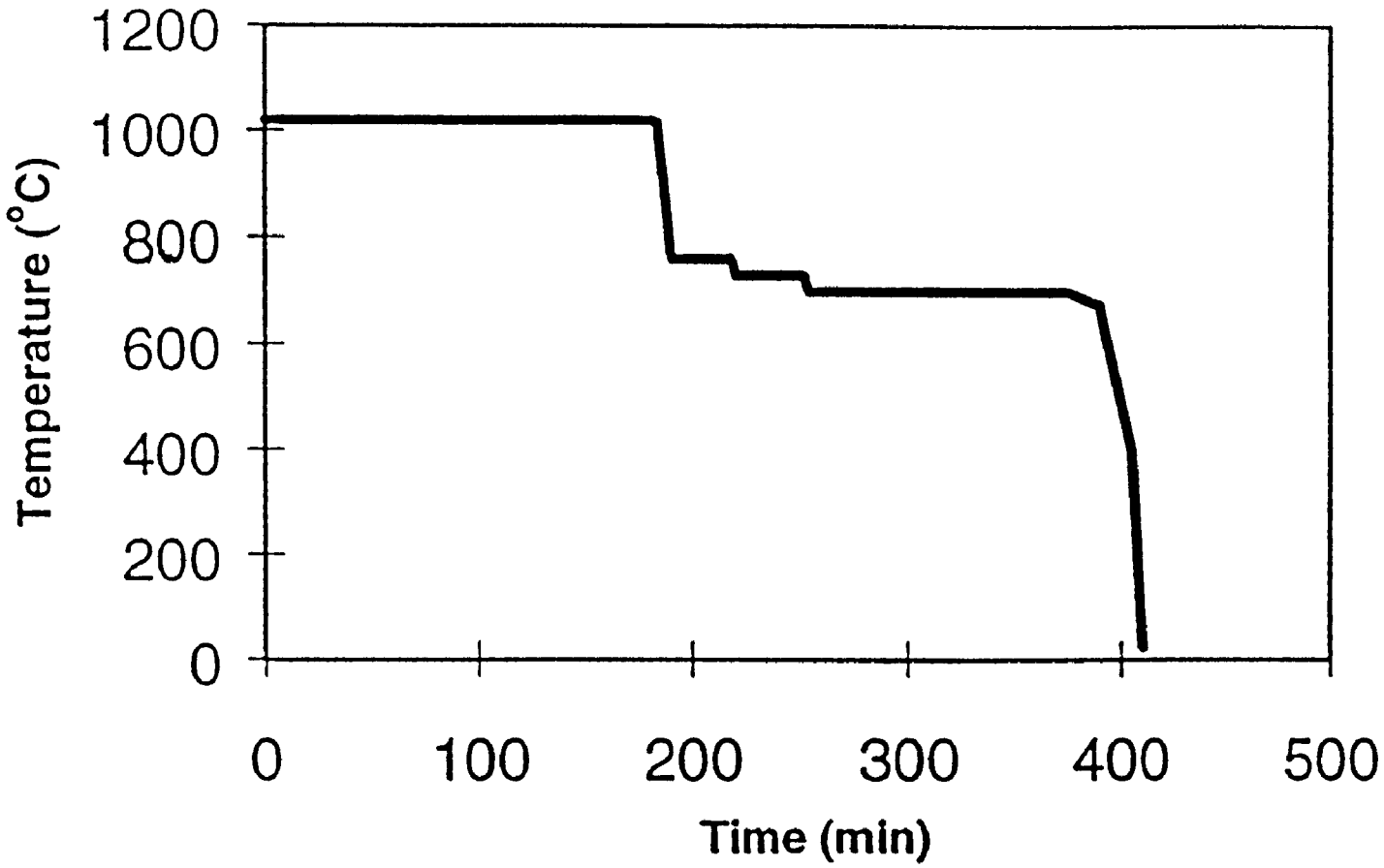
FIG. 1 graphically illustrates the time/temperature profile of the graphitization process utilized in Example 1 of this invention.

The iron-graphite composite powder of this invention is comprised of iron-graphite composite powder particles that possess a microstructure composed of carbon clusters in a ferrous matrix, wherein the carbon clusters may be localized at the surface of the particles or may be embedded within the particles. Preferably, the carbon clusters are temper carbon clusters. In a preferred embodiment of this invention, the iron-graphite composite powder comprises composite powder particles having a microstructure composed of carbon clusters embedded in a ferrous matrix. Advantageously, at least 30% of the carbon clusters present in the composite powder particles are fully embedded in the ferrous matrix. That is, 70% or less of the carbon clusters present in the composite powder particles are located at the surface of the particles. Preferably, at least 50% of the carbon clusters are fully embedded in the ferrous matrix. More preferably, at least 60% of the carbon clusters are fully embedded in the ferrous matrix. Most preferably, at least 70% of the carbon clusters are fully embedded in the ferrous matrix. The ferrous matrix of the composite powder may be comprised of ferrite, pearlite, ausferrite, bainite, martensite, austenite, free cementite, tempered martensite or a mixture thereof. Preferably, the iron-graphite composite powder of this invention possesses a microstructure composed of carbon clusters embedded in a substantially ferritic matrix (at least 60% ferrite). More preferably, the iron-graphite composite powder of this invention possesses a microstructure composed of carbon clusters embedded in a mixed ferritic and pearlitic matrix (at least 80% ferrite). Most preferably, the iron-graphite composite powder of this invention possesses a microstructure composed of carbon clusters embedded in a fully ferritic matrix. Accordingly, in the preferred embodiments of this invention, the iron-graphite composite powder possesses the metallographic microstructure of malleable iron. That is, the iron-graphite composite powder is a miniaturized form of malleable iron.

The iron-graphite composite powder of this invention is an iron-carbon-silicon alloy comprising about 2% to about 4.5% by weight carbon and about 0.05% to about 2.5% by weight silicon. Preferably, the composite powder comprises about 3% to about 4% by weight carbon and about 0.1% to about 2% by weight silicon. In one preferred embodiment, the composite powder comprises about 3% to about 4% by weight carbon and about 0.3% to about 2% by weight silicon. Exemplary iron-graphite composite powders according to this invention, having a microstructure comprised of carbon clusters embedded in a ferrous matrix, comprise about 3.2% to about 3.7% by weight carbon and about 0.8% to about 1.3% by weight silicon. Preferably, the iron-graphite composite powders according to this invention have a microstructure comprised of carbon clusters embedded in a ferrous matrix, comprise about 3.5% to about 3.7% by weight carbon and about 0.8% to about 1.0% by weight silicon. The composite iron powder and/or resulting sintered articles of this invention may also contain at least one other alloying element conventionally used in the art. Exemplary alloying elements include, but are not limited to, manganese, nickel, molybdenum, copper, chromium, boron, phosphorus or a mixture thereof. The iron-graphite composite powder of this invention may be a composite alloy powder wherein at least one alloying element is present in the liquid iron prior to atomization.

A liquid iron alloy useful in this invention may be prepared by dissolving at least one alloying element in elemental form or at least one alloy or compound containing at least one of the alloying elements with a liquid iron. Alternatively, the iron-graphite composite powder of this invention may be a composite powder blend, wherein at least one alloying element in elemental form or at least one alloy or compound containing at least one of the alloying elements is blended with the graphitized composite powder to form the composite powder blend. The elemental alloying elements, alloys and/or compounds useful for alloying with the liquid iron or blending with the iron-graphite powder to provide the powder alloy or powder blend described above, are well known in the art. It is considered within the ordinary skill of one in the art to select suitable elemental alloying elements (e.g., $Cu^0$), suitable alloys (e.g. ferroalloys, such as ferrophosphorus) or suitable compounds (e.g., boron nitride) containing a desired alloying element to provide the powder alloys and/or powder blends of this invention having any desired elemental composition.

The composite iron powder and/or resulting sintered articles of this invention may contain less than about 2% manganese, less than about 4% nickel, less than about 4% molybdenum, less than about 2% chromium, less than about 0.2% boron, less than about 1% phosphorus and/or less than about 3% copper. Preferably, when the composite powder is a copper-containing alloy, the powder contains less than about 1% copper, whereas when the composite powder is a copper-containing blend, the composite powder blend contains less than about 3% copper. Alternatively, the composite powder and/or sintered article may contain less than about 1% manganese, less than about 1.5% nickel, less than about 1.5% molybdenum, less than about 1% chromium and/or less than about 0.5% phosphorus. The composite iron powder and/or resulting sintered articles of this invention may contain any of the above-listed elements but may also contain less than about 0.7% manganese and/or less than about 0.15% phosphorus. In another embodiment, the composite iron powder and/or resulting sintered articles of this invention may contain any of the above-listed elements but may contain less than about 0.1% manganese. The iron-graphite composite powder of this invention having a microstructure comprised of carbon clusters embedded in a ferrous matrix may be prepared by a process comprising the steps of:

(a) atomizing a liquid iron to form an atomized iron powder;

(b) heating the atomized iron powder to a first stage graphitization temperature; and (c) cooling the powder from the first stage graphitization temperature to a second stage graphitization temperature. The ferrous matrix of the iron-graphite composite powder prepared by the process of this invention may be ferrite, pearlite, ausferrite, bainite, martensite, austenite, free cementite, tempered martensite or a mixture thereof. Preferably, the iron-graphite composite powder produced by this method possesses a microstructure composed of carbon clusters embedded in a substantially (at least 60%) ferritic matrix, more preferably, a mixed ferritic and pearlitic matrix (at least 80% ferrite), and most preferably, a fully ferritic matrix.

The first step of this process comprises atomization of a liquid iron to form an iron powder. Advantageously, the process of this invention provides an iron powder wherein each as-atomized particle of the powder is of uniform chemical composition. Atomization of a liquid iron alloy containing at least carbon and silicon provides an iron powder wherein each particle of the powder contains the same or substantially the same concentration of carbon and silicon. Atomization may be conducted using water-atomization or gas-atomization techniques. Preferably, water-atomization is used to provide an iron powder having irregularly shaped particles having a mean particle size of less than about 300 microns and a microstructure of metastable iron carbides and austenite, occasionally with martensite. The iron powder particles possess a microstructure comprised of metastable iron carbides in an austenite matrix which results from the instant solidification of the liquid iron in the atomization process. The microstructure of the atomized particles is dependent upon chemical composition (all other atomization parameters being constant). For example, atomized particles of iron powders having a low carbon concentration typically possess a microstructure with more austenite and a less massive carbide network. Iron powders having high carbon concentration tend to possess a microstructure with massive carbide networks and less austenite, which facilitates the graphitization process.

The atomized iron powder may then be subjected to a graphitization process comprising a first stage graphitization process and a second stage graphitization process. Two distinct transformations occur during these processes. The first transformation involves the decomposition of carbides present in the iron powder and the nucleation and growth of graphite (carbon clusters). The second transformation involves the transformation of the structure of the iron in the powder and further growth of the carbon clusters.

First stage graphitization is a heating process during which the decomposition of carbides and the excess carbon present in the supersaturated austenite supply the carbon for the nucleation and growth of the carbon clusters. The process comprises heating the iron powder to a first stage graphitization temperature that is greater than about 900° C. but that is below the melting point of the powder. Preferably, the iron powder is heated to a temperature of greater than 1,000° C. This heating process comprises two phases, a heating phase, during which nucleation (localization) of the carbon clusters occurs and an optional maintaining phase, during which decomposition of the carbides is completed. Control of the localization of the carbon clusters in the resulting powder particles (i.e., embedded vs. surface) is obtained by controlling the rate of heating, during the heating phase, from a temperature of about 650° C. to greater than about 900° C., preferably to greater than about 1000° C. In a preferred embodiment of this invention, the iron-graphite powder is heated from about 650° C. to greater than about 900° C. at a rate such that nucleation of at least 30% of the carbon clusters is localized within the particles, that is, at least 30% of the carbon clusters formed in the composite powder particles are fully embedded within the ferrous matrix. Preferably, the iron-graphite powder is heated from about 650° C. to greater than about 900° C. at a rate such that at least 50% of the carbon clusters are fully embedded in the ferrous matrix. More preferably, the iron-graphite powder is heated from about 650° C. to greater than about 900° C. at a rate such that at least 60% of the carbon clusters are fully embedded in the ferrous matrix. Most preferably, the iron-graphite powder is heated at a rate such that at least 70% of the carbon clusters are fully embedded in the ferrous matrix. After the temperature of the iron powder reaches a temperature between about 850° C. and the first stage graphitization temperature, the powder may be maintained within that range of temperatures or at the first graphitization temperature for a period of time that is sufficient to effect decomposition of the carbides present in the iron powder (the maintaining phase). Preferably, the iron-graphite powder is treated such that complete decomposition of the carbides is achieved during the first stage graphitization process. However, iron-graphite composite powders containing residual amounts of carbides (up to about 10%) are encompassed within the scope of this invention and are useful in the preparation of the fully dense or substantially fully dense sintered articles described herein. Once a desired degree of carbide decomposition is attained, the iron powder sample may be subjected to the second graphitization process.

Preferably, the heating process may be adjusted based on the chemical composition of the iron-graphite composite powder sample and the as-atomized structure of powder such that the powder is heated from a temperature of about 650° C. to the first stage graphitization temperature of greater than about 900° C., preferably greater than about 1000° C., at a rate sufficient to provide for nucleation of the carbon clusters in the core of the iron powder particles and, optionally, the powder sample is maintained at a temperature between about 850° C. and greater than about 900° C. (preferably greater than about 1000° C.) or at the temperature greater than about 900° C. (preferably greater than about 1000° C.) for a period of time sufficient to obtain complete decomposition of the carbides in the powder. For example, an iron-graphite composite powder containing about 3.2% to about 3.7% by weight carbon and about 0.8% to about 1.3% by weight silicon, or preferably, about 3.5% to about 3.7% by weight carbon and about 0.8% to about 1.0% by weight silicon, may be heated from a temperature of about 650° C. to greater than about 900° C., preferably greater than about 1000° C., at a rate of greater than about 30° C./min. to achieve precipitation/nucleation of greater than 30% of the carbon clusters in the core of the powder particles. That is, heating at a rate of greater than about 30° C./min. provides an iron-graphite composite powder wherein greater than 30% of the carbon clusters present in the powdered particles are fully embedded in the ferrous matrix. For such a powder, a heating rate of less than about 30° C./min. results in localization/nucleation of greater than 70% of the carbon clusters at the surface of the powder particles. After the iron powder sample reaches the first stage graphitization temperature of greater than about 900° C., preferably greater than about 1000° C., the iron powder may be maintained at that first stage graphitization temperature for a time period of about 5 minutes to about 16 hours to complete the decomposition of the carbides in the iron powder.

Second stage graphitization comprises a controlled cooling of the iron powder from the first stage graphitization temperature to a second stage graphitization temperature during which transformation of the structure of the iron in the powder and diffusion of carbon to the nucleation sites for growth of the carbon clusters occur. Specifically, the second stage graphitization of this invention comprises a controlled cooling of the iron powder from a temperature of greater than 700° C., preferably from a temperature of less than about 800° C. (but greater than 700° C.), to a second stage graphitization temperature. In the process of this invention, the powder is cooled to a suitable second graphitization temperature, at an overall rate that is sufficient to provide for diffusion of carbon to the nucleation sites to ensure growth of the carbon clusters, which thus provides for the transformation of the iron structure in the powder (e.g., to a substantially ferritic microstructure comprising transformation from austenite to ferrite, austenite to pearlite and pearlite to ferrite) to thereby form a composite powder having a microstructure composed of carbon clusters embedded in a ferrous matrix. The composite iron powder, thus formed, may be cooled to room temperature, or to any temperature suitable for further handling (e.g., processing into sintered articles, packaging, etc.). The controlled cooling of the second graphitization process may be a continuous cooling process (e.g., conducted by passing the powder on a conveyor belt through a differentially heated oven or through a contiguous set of ovens heated to consecutively lower temperatures) or a stepwise cooling process comprised of separate cooling and maintaining steps (e.g., conducted by holding the powder in a single oven and reducing the temperature of the oven in a stepwise manner). The temperature difference between portions of the oven, between ovens or between temperature settings of an oven may cause the powder to temporarily cool at a rate that is faster than the desired overall cooling rate. As illustrated in FIG. 1, however, a suitable overall cooling rate may be achieved by a cooling process comprising intervals of rapid cooling, followed by intervals of no cooling (i.e., maintaining the iron at a selected temperature). For example, a powder containing about 3.2% to about 3.7% by weight carbon and about 0.8% to about 1.3% by weight silicon, or preferably, about 3.5% to about 3.7% by weight carbon and about 0.8% to about 1.0% by weight silicon, may be cooled from a temperature of greater than 700° C., preferably from a temperature of less than about 800° C., to a second stage graphitization temperature at an overall cooling rate no faster than 10° C./min. to effect transformation of the structure of the iron, diffusion of carbon and growth of the carbon clusters in the powder particles. For such a powder, cooling at a rate faster than about 10° C./min. does not provide sufficient time for the transformation of austenite to ferrite; that is, some portion of the carbon remains in the ferrous matrix and the growth of the carbon clusters is not complete.

Temperatures greater than about 600° C. are suitable as second stage graphitization temperatures, however, the temperature may vary depending on the presence and/or concentration of alloying elements in the powder. Preferably, the second stage graphitization temperature is greater than 650° C., and more preferably, is not less than about 700° C. It will be appreciated by those in the art that the presence and/or concentration of alloying elements in the composite powder of this invention may effect not only the temperature to which the controlled cooling should be conducted (the second stage graphitization temperature) but also the ferrous matrix of the composite powder obtained thereby, after cooling from the second graphitization temperature to room temperature. For example, for a powder containing about 3.2% to about 3.7% by weight carbon and about 0.8% to about 1.3% by weight silicon, or preferably, about 3.5% to about 3.7% by weight carbon and about 0.8% to about 1.0% by weight silicon, the second graphitization temperature is greater than about 700° C. and the overall cooling rate is no faster than 10° C./min., preferably, no faster than about 4° C./min. In view of the teachings herein, it is considered within the ordinary skill of one in the art to modify the second stage graphitization temperature, depending on the nature and concentration of the alloying elements in an iron powder, to obtain a composite iron powder having a microstructure comprising carbon clusters embedded in a desired ferrous matrix.

The second stage graphitization process may be conducted immediately after the first stage graphitization process, or it may be conducted as a separate process, at a later time. For example, the controlled cooling of the second stage graphitization process may be conducted in a manner such that the temperature of the iron powder is reduced directly from the first stage graphitization temperature of greater than about 900° C. to a second stage graphitization temperature, wherein the rate of cooling of the iron powder from a temperature of greater than 700° C., preferably from a temperature of less than about 800° C., to the second graphitization temperature is sufficient to provide for diffusion of carbon to the nucleation sites to ensure growth of the carbon clusters, providing for the transformation of the iron structure in the powder. Alternatively, the second stage graphitization process may be conducted as a separate step comprising the re-heating of an iron sample. For example, an iron powder sample may be first heated to the first stage graphitization temperature of greater than about 900° C., cooled to a temperature of less than about 600° C. (e.g., room temperature), re-heated to a temperature at least greater than 700° C., then subjected to the controlled cooling of the second stage graphitization process, wherein the rate of cooling of the iron powder from the temperature greater than 700° C. to the second graphitization temperature is sufficient to provide for diffusion of carbon to the nucleation sites to ensure growth of the carbon clusters, providing for the transformation of the iron structure in the powder. Preferably, the iron powder may be re-heated to a temperature greater than about 800° C. to ensure rapid transformation of pearlite to austenite.

Accordingly, an iron-graphite composite powder comprising particles having a microstructure comprised of carbon clusters embedded in a ferrous matrix may be prepared from an atomized iron powder using a continuous cooling process comprising the steps of:

(a) heating the atomized iron powder to a temperature of greater than about 900° C.; and (b) cooling the powder from a temperature of greater than about 900° C. to a temperature greater than about 600° C.

In this process, the powder is heated from a temperature of about 650° C. to greater than about 900° C. at a rate sufficient to permit nucleation of the carbon clusters in the core of the powder particles and the powder is optionally maintained at a temperature between about 850° C. and greater than about 900° C. or at the temperature greater than about 900° C. for a time sufficient to achieve a desired degree of decomposition of the carbides in the powder. Thereafter, the powder is cooled from a temperature greater than 700° C., preferably from a temperature of less than about 800° C. (but greater than 700° C.), to the temperature greater than about 600° C. at a rate sufficient to achieve the transformation of the iron structure in the powder and to provide for growth the carbon clusters. That is, the powder is heated from a temperature of about 650° C. to a first graphitization temperature of greater than about 900° C., preferably greater than about 1000° C., at a rate sufficient to permit nucleation of the carbon clusters in the core of the powder particles, the powder is optionally maintained at a temperature between about 850° C. and the first stage graphitization temperature or at the first graphitization temperature for a time sufficient to achieve a desired degree of decomposition of the carbides in the iron powder, and the powder is cooled from the first graphitization temperature of greater than about 900° C., preferably greater than about 1000° C., to a temperature greater than 700° C., preferably to a temperature of less than about 800° C., then cooled from a temperature of greater than 700° C., preferably from a temperature of less than about 800° C., to a second graphitization temperature of greater than about 600° C. at a rate sufficient to provide for the transformation of the iron structure in the powder and to provide for diffusion of carbon to the nucleation sites to thereby form a composite powder having a microstructure composed of carbon clusters embedded in a ferrous matrix. For example, for a powder containing about 3.2% to about 3.7% by weight carbon and about 0.8% to about 1.3% by weight silicon, or preferably, about 3.5% to about 3.7% by weight carbon and about 0.8% to about 1.0% by weight silicon, heating the powder from a temperature of about 650° C. to greater than about 1000° C. at a rate of greater than 30° C./min., maintaining the powder at the temperature of greater than about 1000° C. for about 5 minutes to about 16 hours, and cooling the powder at a rate no faster than about 10° C./min., preferably, no faster than about 4° C./min., to a temperature of greater than about 700° C. is sufficient to form a composite powder having a microstructure composed of carbon clusters embedded in a ferrous matrix.

The cooling process may also comprise the steps of:

(1) cooling the powder from a temperature of greater than about 900° C. to a temperature of below about 600° C.;

(2) re-heating the powder to a temperature of greater than about 700° C.; and (3) cooling the powder from a temperature of greater than about 700° C. to a temperature of greater than 600° C. Preferably, the powder is re-heated to temperature greater than 800° C. and cooled, in the manner described above, to a temperature of not less than 700° C.

Another embodiment of the process of this invention for the preparation of an iron-graphite composite powder from an atomized iron powder comprises a stepwise cooling and maintaining process, comprising the steps of:

(a) heating the atomized iron powder to a temperature of greater than about 900° C.; and (b) cooling the powder from a temperature of greater than about 900° C. to a temperature of greater than about 600° C.;

wherein the cooling step comprises a combination of cooling and maintaining steps selected from:

(i) cooling the powder from a temperature of greater than about 900° C. to a temperature greater than about 600° C. and maintaining the powder at the temperature greater than about 600° C.;

(ii) optionally cooling the powder from the temperature greater than about 600° C. to another temperature greater than about 600° C. and maintaining the powder at said temperature; and (iii) optionally repeating step (ii).

In this embodiment of the process of this invention, the powder is heated from a temperature of about 650° C. to greater than about 900° C. at a rate sufficient to permit nucleation of the carbon clusters in the core of the powder particles, the powder is optionally maintained at a temperature between about 850° C. and greater than about 900° C. or at the temperature greater than about 900° C. for a time sufficient to achieve a desired degree of decomposition of the carbides in the powder, in the manner described above. The powder is thereafter cooled from a temperature of greater than about 900° C. to a temperature of greater than 700° C., then cooled using the combination of cooling and maintaining steps from a temperature of greater than 700° C. to a temperature greater than about 600° C. at a rate sufficient to achieve the transformation of the iron structure in the powder and to provide for growth the carbon clusters. This cooling process may also comprise the steps of:

(1) cooling the powder from a temperature of greater than about 900° C. to a temperature of below about 600° C.;

(2) re-heating the powder to a temperature of greater than about 700° C.; and (3) cooling the powder from a temperature of greater than about 700° C. to a temperature of greater than 600° C.;

(4) maintaining the powder at the temperature of greater than about 600° C.; and (5) optionally repeating steps (3) and (4), above. Preferably, the powder is re-heated to a temperature greater than 800° C. and cooled to a temperature of not less than 700° C. The stepwise cooling/maintaining process typically comprises repeating the cooling and maintaining steps two or more times and is characterized by reducing the temperature of the powder, followed by maintaining the powder at the reduced temperature for a period of time sufficient to provide for the transformation of the iron structure in the powder and to provide for diffusion of carbon to the nucleation sites. Example 1 describes a stepwise cooling/maintaining process comprised of three cooling/maintaining cycles, wherein the overall cooling rate from the first graphitization temperature of greater than about 900° C. to the second graphitization temperature of greater than about 600° C. was slower than 2° C./minute and the overall cooling rate from a temperature of greater than 700° C. (e.g., 760° C.) to a temperature of greater than 600° C. (e.g., 700° C.) was slower than 1° C./minute. In this example, the powder was maintained at each of three reduced temperature levels of not less than about 700° C. (e.g., 760° C., 730° C., and 700° C.) for at least 1.25 hours/cycle.

In the process of this invention, the concentration of silicon in the iron powder may be used to modify the microstructure of the composite powder obtained in this invention. Silicon promotes formation of the nucleation sites for carbon. Higher concentrations of silicon in the atomized iron-graphite powder provide more nucleation sites that result in rapid graphite nucleation, whereas lower silicon concentrations provide fewer nucleation sites and result in comparatively slower graphite nucleation. During the heating and cooling stages, these effects of silicon concentration, in turn, affect the microstructure of the iron-graphite composite powder produced over time and the total time it takes to obtain the desired microstructure. However, the effect of silicon on the resulting microstructure of the iron-graphite composite powder is reduced when the powder contains a carbon concentration of more than about 3.4%.

Transformation of the iron structure of the powder (e.g., from austenite to ferrite) will occur rapidly in an iron powder containing a high concentration of nucleation sites (high silicon concentration, e.g., >1.0% silicon by weight) due to the rapid diffusion (short diffusion paths) of the carbon in the austenite to the carbon clusters. Transformation of austenite to ferrite may occur very slowly in an iron powder containing a low concentration of nucleation sites (low silicon concentration, e.g., <0.5% silicon by weight), requiring a comparatively longer cooling period. Graphitization of an atomized iron powder containing a low silicon concentration and low carbon concentration results in a gradual transformation of austenite to pearlite, then to a ferrite/pearlite mixture due to the long time it takes for the carbon to diffuse to the carbon clusters (long diffusion path of the carbon in the austenite). Graphitization of an atomized iron powder containing a low silicon concentration and high carbon concentration results in a more rapid transformation of austenite to a ferrite/pearlite mixture because the increased nucleation of the carbon clusters (high C concentration) results in shortening the diffusion path of the carbon in the austenite to the nucleation site. Thus, the microstructure of the composite powder produced by the process of this invention may be influenced by modifying the concentrations of silicon and carbon in the iron-graphite composite powder and by modifying the length of time that the cooling process is conducted.

In addition, the atmosphere in which the process is conducted may also be used to affect the microstructure of the composite powder produced in this invention. For example, the atmosphere and the rate at which nucleation occurs may be modified to affect the rate of decarburization of the iron-graphite powder during processing. Decarburization is the reaction of carbon with oxygen, which reduces the amount of carbon available for formation of the carbon clusters. Accordingly, use of high silicon and carbon concentrations and rapid heating of the powder to temperatures in the range of about 650° C. to greater than about 1000° C. range promotes core graphite nucleation and functions to sequester higher amounts of carbon within the iron matrix, thereby reducing the amount of carbon available for reaction with oxygen (decarburization). In addition, conducting the graphitization process in an atmosphere that is substantially free of oxygen will minimize decarburization. A substantially oxygen-free atmosphere contains less than about 3.0% oxygen, and preferably less than about 1.0% oxygen. The substantially oxygen-free atmosphere may be an atmosphere of argon, nitrogen, helium, hydrogen or a mixture thereof. Preferably, the substantially oxygen-free atmosphere contains less than about 10% hydrogen. Alternatively, the substantially oxygen-free atmosphere may be a vacuum with a pressure of less than about 30 mm $Hg^0$. Preferably, the process is conducted in an argon or a nitrogen atmosphere. Most preferably, the process is conducted in a nitrogen atmosphere Conducting the graphitization process in different atmospheres may also be used to provide iron-graphite composite powders having different microstructures. For example, hydrogen possesses a high thermal conductivity. Accordingly, when the cooling process is conducted in an atmosphere of hydrogen or dissociated ammonia, rapid cooling of the powder may result. If the overall cooling rate of the cooling process is very rapid, a product may be formed having a microstructure having incomplete graphitization (having less than a substantially ferritic matrix, e.g., <60% ferrite). The amount of graphite nucleation that is present at the particle surface depends on the amount of oxide present at the surface. Accordingly, the controlled cooling process may be modified to provide adequate time for transformation of the structure of the powder to a substantially ferritic matrix (e.g., 60%) and growth of the carbon clusters within the particles. For example, the cooling process may be modified to provide for an overall cooling rate that is slower than about 10° C./minute, or if desired, slower than about 4° C./minute by providing longer cooling or longer cooling/maintaining time periods. The rapid reduction of the surface oxides formed during atomization by hydrogen ($H_2$) present in such atmospheres may result in a microstructure wherein graphite nucleation occurs at the surface of the particles (Comparative Example 1) rather than within the particles. Accordingly, the process is conducted in a substantially oxygen-free atmosphere containing less than about 10% hydrogen.

In view of the teachings herein, it is considered to be within the ordinary skill of one in the art to adjust through routine experimentation the iron powder composition, the temperature to which the powder is heated, the rate at which the powder is heated, the length of time the powder is maintained (in the maintaining phase) to achieve a desired level of carbide decomposition, the rate and manner of cooling to provide iron-graphite composite powders having a microstructure composed of carbon clusters embedded in a ferrous matrix. The microstructure of an iron-graphite composite powder sample may be determined using conventional techniques, for example, by mounting the powder in an appropriate medium, polishing the resulting sample and visually examining the structure of the particle under a microscope.

The iron-graphite powder thus formed, having the metallographic microstructure of malleable iron, may be used in powder metallurgy technology for the preparation of sintered articles, e.g., metal parts, having excellent machinability, strength and toughness. Accordingly, to be suitable for powder metallurgy processing, the iron-graphite composite powder according to this invention possesses a mean particle size of less than about 300 microns. If the composite powder is a composite powder blend, the blended components (the elemental alloying elements, alloys or compounds containing the alloying elements described above) will also possess a mean particle size of less than about 300 microns. The iron-graphite composite powder, described herein, may be subjected to sintering according to generally conventional methods by forming a green compact by press molding the iron-graphite composite powder and sintering the green compact. The sintered article thus formed may then be subjected to post-sintering treatments, e.g., heat-treatment (such as quenching and tempering, and the like), coining, forging and cutting or machining, to produce a final article. The article thus formed possesses a metallographic microstructure of malleable iron containing carbon clusters embedded in a ferrous matrix, wherein the ferrous matrix may be ferrite, pearlite, ausferrite, bainite, martensite, tempered martensite or a mixture thereof. The size of the carbon clusters in the sintered article is similar to the size of the clusters in the powder used to prepare the article. Accordingly, compared to the structure of articles prepared from cast malleable iron, the sintered articles prepared by the method of this invention possess a structure of miniature carbon clusters dispersed throughout a ferrous matrix.

It is important to note that the melting point of the iron-graphite composite powder of this invention is significantly lower than conventional iron powders. For example, the melting point of an iron-graphite composite powder according to this invention containing 0.94% by weight silicon and 3.29% by weight carbon is about 1150° C.–1225° C. In contrast, conventional iron may be sintered at temperatures as high as 1400° C., without any evidence of melting. Accordingly, sintering of the iron-graphite powders of this invention may be conducted at the comparatively low temperatures of above about 1140° C. to less than about 1200° C. When iron-graphite powder samples are sintered at temperatures near the liquidus temperature of the powder, some liquid phase sintering may occur. The occurrence of liquid phase sintering results in the formation of sintered articles having high density. Accordingly, sintering articles prepared using an iron-graphite composite powder of this invention at temperatures of above about 1140° C. to less than about 1200° C. can provide fully dense or substantially fully dense materials, whereas sintering at temperatures below about 1140° C. may provide sintered articles that are less than fully dense. For example, optical metallography of a sintered compact, prepared using an iron-graphite powder of this invention containing about 3.2% to about 3.7% by weight carbon and about 0.8% to about 1.3% by weight silicon, and sintered at a temperature of about 1155° C., revealed that the sintered article was substantially poreless.

Another embodiment of this invention relates to sintered articles having the microstructure of austempered cast iron. Austempered ductile iron, containing high concentrations of carbon and silicon, possesses good tensile and fatigue strengths, ductility, toughness, wear resistance and machinability. Austempered cast iron is composed of ausferrite, which is characterized by a duplex structure of individual plates of ferrite, separated by layers of carbon-rich austenite.

The austempered sintered articles of this invention are produced by a process of subjecting the sintered article to post-sintering heat treatments. For example, an austempered sintered article may be prepared from a sintered article by the process comprising:

(a) heating the sintered article to a temperature in the range of about 825° C. to about 950° C.;

(b) cooling the article to a temperature in the range of about 150° C. to about 450° C.; and (c) maintaining the article at the temperature in the range of about 150° C. to about 450° C. for about 15 to about 60 minutes. The article thus treated may then cooled to room temperature.

Advantageously, the sintered articles formed from the iron-graphite composite powder of this invention possess excellent machinability properties. Conventionally, additional compounds, such as manganese sulfide and boron nitride are added to iron powders to provide sintered articles having good machinability properties.

The sintered articles prepared from the iron-graphite composite powder of this invention possess excellent machinability properties without these added compounds. As a result of the process of this invention, the carbon clusters of the composite powder are retained in the microstructure of the sintered article and function as lubricants during machining.

The Examples which follow are intended as an illustration of certain preferred embodiments of the invention, and no limitation of the invention is implied.

REFERENCE EXAMPLE 1

An iron powder was produced by water-atomization of a liquid iron containing 0.94% silicon and 3.29% carbon. The water-atomized iron powder was thoroughly dried, then heated in a Lindberg tubular furnace. The furnace was purged five times with a high purity argon (99.99%) prior to introduction of a dry, atomized powder sample, consisting of 10 to 15 grams of powder contained in a ceramic crucible. Graphitization was conducted by heating a set of iron powder samples in an argon atmosphere (99.99%) to a temperature of 1020° C. for 4, 8 or 16 hours. The degree of graphitization of the samples produced thereby was determined by Computerized Image Analysis using conventional procedures. The volume of graphite formed in the above iron samples heated for 4, 8 and 16 hours was 7.9%, 8.3% and 10.2%, respectively.

EXAMPLE 1

Figure 2:
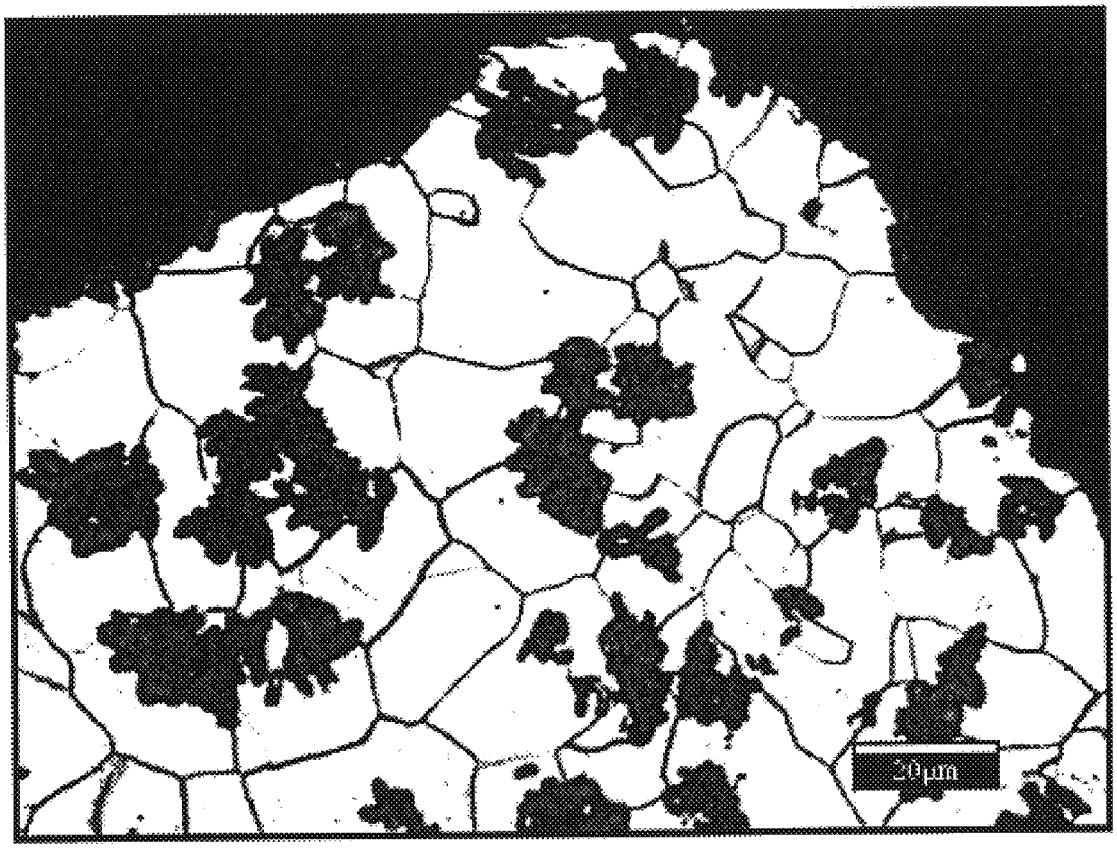
FIG. 2 is a photomicrograph that illustrates the ferritic microstructure of an iron powder sample containing about 10% graphite obtained by a graphitization process conducted in a vacuum atmosphere.

An iron powder was produced by water-atomization of a liquid iron containing 0.94% silicon and 3.29% carbon. The water-atomized iron powder was then thoroughly dried. Five samples of the powder were consecutively heated in a Lindberg tubular furnace under a vacuum atmosphere (less than approximately 30 mm $Hg^0$) at a temperature of 1020° C., maintained at that temperature for three hours, then cooled in a stepwise process for approximately 4 hours. The samples were cooled from 1020° C. to approximately 760° C. and were maintained at that temperature for approximately 1.25 hours, cooled to approximately 730° C. and maintained at that temperature for approximately 1.25 hours, then cooled to approximately 700° C. and maintained at that temperature for approximately 1.5 hours. The samples were thereafter cooled to room temperature. FIG. 1 graphically illustrates the time/temperature profile of the graphitization process followed for this Example and FIG. 2 shows the final microstructure of one of the iron powder samples obtained by this graphitization process. The degree of graphitization of the powder was determined using the process described in Reference Example 1. The five iron-graphite composite samples had an average graphite volume of approximately 10%.

The hardness of the iron-carbon composite samples produced were evaluated against that of ATOMET® 29 and ATOMET® 1001 (available from Quebec Metal Powders, Inc., Tracy, Quebec, Canada). The iron powder of this invention, ATOMET® 29 and ATOMET® 1001 had a hardness values of 100, 98 and 83 $VHN_{50gf}$, respectively.

EXAMPLE 2

Figure 3:
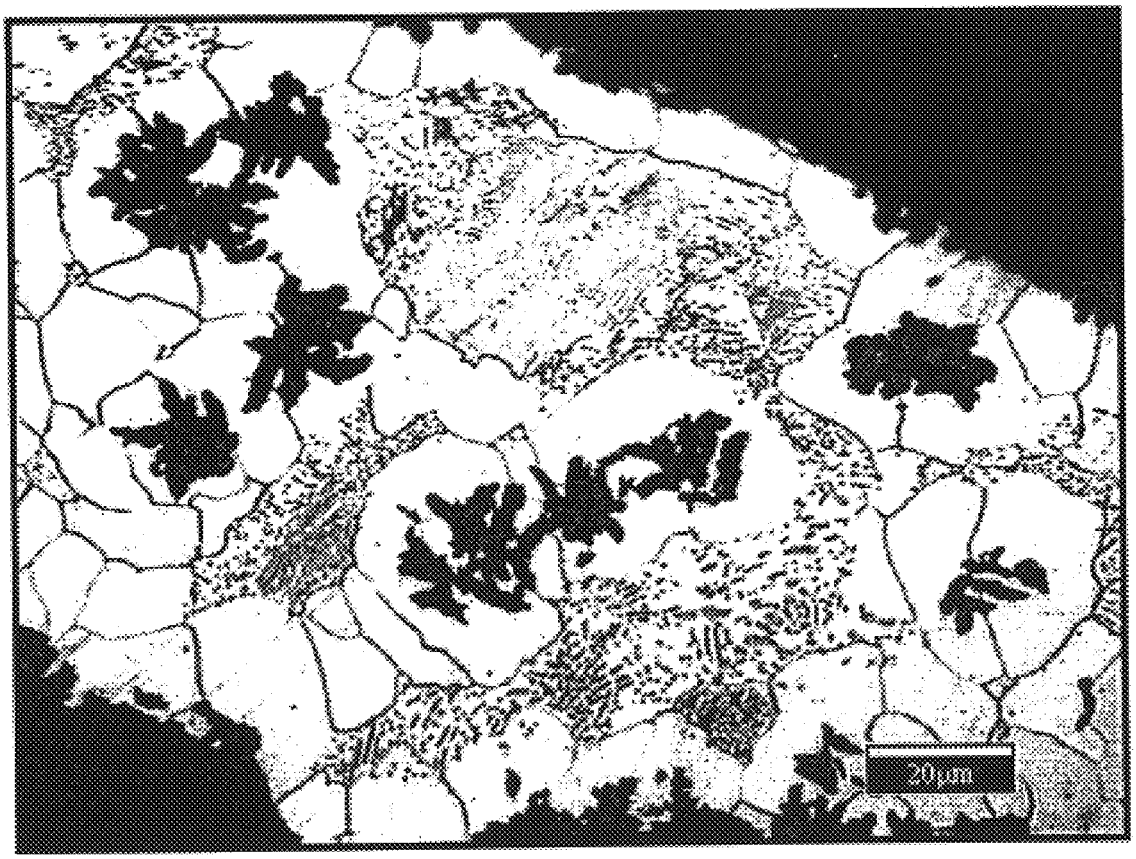
FIG. 3 is a photomicrograph that illustrates the microstructure of an iron powder sample composed of approximately 80% ferrite, 10% graphite and 10% pearlite.

A sample of the water-atomized iron powder described in Example 1, was treated according to the procedure described in Example 1, except that the heating step was conducted for 2 hours and the stepwise cooling process was conducted for approximately 2 hours. The sample was cooled from 1020° C. to approximately 760° C. and was maintained at that temperature for approximately 0.5 hours, cooled to approximately 730° C. and maintained at that temperature for approximately 0.5 hours, then cooled to approximately 700° C. and maintained at that temperature for approximately 1 hour. The sample was thereafter cooled to room temperature. As shown in FIG. 3, the microstructure of the iron powder sample obtained by this graphitization process was a ferrite/pearlite matrix composed of approximately 80% ferrite, approximately 10% pearlite and approximately 10% graphite as carbon clusters.

EXAMPLE 3

An iron powder was produced by water-atomization of a liquid iron containing 1.33% silicon and 3.32% carbon. The water-atomized iron powder was thoroughly dried, then heated in a Lindberg tubular furnace under a vacuum atmosphere (less than approximately 30 mm $Hg^0$) at a temperature of 1020° C., maintained at that temperature for 0.25 hours, then cooled in a stepwise process for approximately 1 hour. The sample was cooled from 1020° C. to approximately 760° C. and was maintained at that temperature for approximately 0.5 hours, then cooled to approximately 700° C. and maintained at that temperature for approximately 0.5 hours. The sample was thereafter cooled to room temperature. The microstructure of the iron powder sample obtained by this graphitization process was a fully ferritic matrix containing embedded carbon clusters.

EXAMPLE 4

An iron powder was produced by water-atomization of a liquid iron containing 1.33% silicon and 3.32% carbon. The water-atomized iron powder was thoroughly dried, then heated in a Lindberg tubular furnace under a nitrogen atmosphere at a temperature of 1020° C., maintained at that temperature for 0.25 hours, then cooled in a stepwise process for approximately 1.25 hours. The sample was cooled from 1020° C. to approximately 760° C. and was maintained at that temperature for approximately 0.25 hours, cooled to approximately 740° C. and maintained at that temperature for approximately 0.25 hours, cooled to approximately 730° C. and maintained at that temperature for approximately 0.25 hours, cooled to approximately 720° C. and maintained at that temperature for approximately 0.25 hours, then cooled to approximately 700° C. and maintained at that temperature for approximately 0.25 hours. The sample was thereafter cooled to room temperature. The iron powder sample obtained by this graphitization process possessed a microstructure composed of a fully ferritic matrix containing embedded carbon clusters.

EXAMPLE 5

A standard transverse rupture specimen was manufactured by compacting a sample of the iron-graphite composite produced according to the procedure of Example 1 at 110,200 psi and sintering the compact at a temperature of about 1155° C. A comparative standard transverse rupture specimen of ATOMET® 29, admixed with 0.9 wt% graphite, was similarly prepared. In testing conducted according to ASTM B-528-839, the iron-graphite powder specimen demonstrated a sintered traverse rupture strength of 154,553 (lb/in$^2$), whereas the ATOMET® 29 (plus 0.9% graphite) specimen demonstrated a sintered traverse rupture strength of 119,809 (lb/in$^2$).

COMPARATIVE EXAMPLE 1

Figure 4:
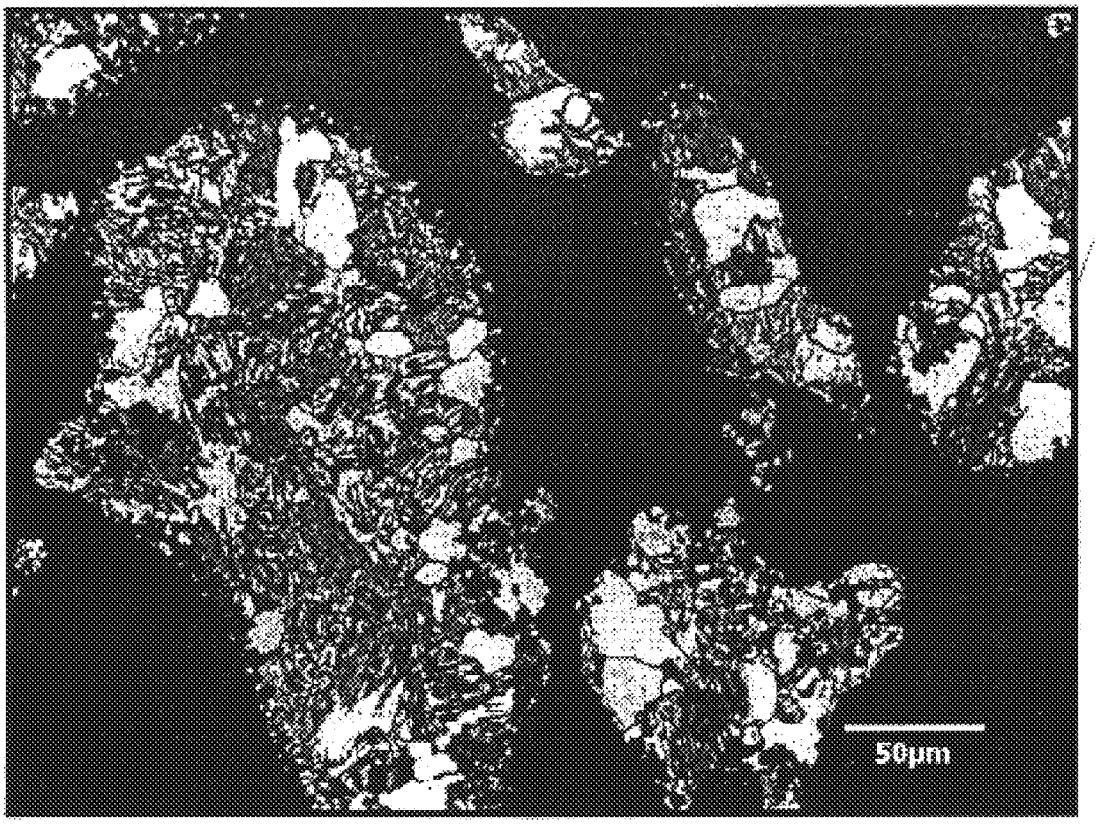
FIG. 4 is a photomicrograph that illustrates the microstructure of an iron powder sample obtained by an incomplete graphitization process conducted in a dissociated ammonia ($N_2/H_2$) atmosphere, containing carbon clusters located mostly at the surface of the powder particles.

An iron powder was produced by water-atomization of a liquid iron containing 1.33% silicon and 3.32% carbon. The water-atomized iron powder was thoroughly dried, then heated in a Lindberg tubular furnace under an atmosphere of dissociated ammonia (75% $H_2$/25% $N_2$) at a temperature of 1020° C., maintained at that temperature for 0.25 hours, then cooled in a stepwise process for approximately 1.66 hours. The sample was cooled from 1020° C. to approximately 760° C. and was maintained at that temperature for approximately 0.5 hours, cooled to approximately 740° C. and maintained at that temperature for approximately 0.33 hours, cooled to approximately 720° C. and maintained at that temperature for approximately 0.33 hours, then cooled to approximately 700° C. and maintained at that temperature for approximately 0.5 hours. The sample was thereafter cooled to room temperature. As shown in FIG. 4, the microstructure of the iron powder sample obtained by this graphitization process was a ferrite/pearlite matrix containing carbon clusters located mostly at the surface of the powder particles.

Other variations or modifications, which will be obvious to those skilled in the art through routine experimentation are within the scope and teachings of this invention. This invention is not to be limited except as set forth in the following claims.

We claim:

1. An iron-graphite composite powder comprising iron-graphite composite powder particles comprising about 2% to about 4.5% by weight carbon and about 0.05% to about 2.5% by weight silicon and having a microstructure comprised of temper carbon clusters embedded in a ferrous matrix, wherein at least 30% of the carbon clusters are fully embedded within the ferrous matrix.

2. The iron-graphite composite powder according to claim 1, wherein at least 50% of the carbon clusters are fully embedded within the ferrous matrix.

3. The iron-graphite composite powder according to claim 1, wherein at least 70% of the carbon clusters are fully embedded within the ferrous matrix.

4. The iron-graphite composite powder according to any one of claims 1 to 3, wherein said carbon clusters are embedded in a substantially ferritic matrix.

5. The iron-graphite composite powder according to any one of claims 1 to 3, comprising about 3% to about 4% by weight carbon and about 0.3% to about 2% by weight silicon.

6. The iron-graphite composite powder according to any one of claims 1 to 3, having a particle size of less than about 300 microns.

7. The iron-graphite composite powder according to any one of claims 1 to 3, comprising at least one alloying element.

8. The iron-graphite composite powder according to any one of claims 1 to 3, comprising at least one of manganese, nickel, molybdenum, copper, chromium, boron, phosphorus or a mixture thereof.

9. The iron-graphite composite powder according to claim 8, wherein the powder is an alloy comprising at least one of manganese, nickel, molybdenum, copper, chromium and phosphorus.

10. The iron-graphite composite powder according to claim 8, wherein the powder is a blend comprising at least one of manganese, nickel, molybdenum, copper, chromium, boron and phosphorus.

11. The iron-graphite composite powder according to claim 9, comprising less than about 2% manganese.

12. The iron-graphite composite powder according to claim 9, comprising less than about 1% manganese.

13. The iron-graphite composite powder according to claim 9, comprising less than about 0.7% manganese.

14. The iron-graphite composite powder according to claim 9, comprising less than about 0.1% manganese.

15. The iron-graphite composite powder according to claim 9, comprising less than about 4% nickel.

16. The iron-graphite composite powder according to claim 9, comprising less than about 1.5% nickel.

17. The iron-graphite composite powder according to claim 9, comprising less than about 4% molybdenum.

18. The iron-graphite composite powder according to claim 9, comprising less than about 1.5% molybdenum.

19. The iron-graphite composite powder according to claim 9, comprising less than about 2% chromium.

20. The iron-graphite composite powder according to claim 9, comprising less than about 1% chromium.

21. The iron-graphite composite powder according to claim 9, comprising less than about 3% copper.

22. The iron-graphite composite powder according to claim 10, comprising less than about 1% copper.

23. The iron-graphite composite powder according to claim 9, comprising less than about 0.2% boron.

24. The iron-graphite composite powder according to claim 9, comprising less than about 1% phosphorus.

25. The iron-graphite composite powder according to claim 9, comprising less than about 0.5% phosphorus.

26. The iron-graphite composite powder according to claim 9, comprising less than about 0.15% phosphorus.

27. A process for preparing an iron-graphite composite powder, wherein said powder is comprised of iron-graphite composite powder particles comprising about 2% to about 4.5% by weight carbon and about 0.05% to about 2.5% by weight silicon and having a microstructure comprised of temper carbon clusters embedded in a ferrous matrix, wherein at least 30% of the carbon clusters are fully embedded within the ferrous matrix, said process comprising the steps of:

(a) atomizing a liquid iron to form an atomized iron powder;

(b) heating the atomized iron powder to a temperature of greater than about 900° C.; and (c) cooling the powder from a temperature of greater than about 900° C. to a temperature greater than about 600° C., wherein the powder is heated from a temperature of about 650° C. to greater than about 900° C. at a rate sufficient to permit nucleation of the carbon clusters in the core of the powder particles and wherein the powder is cooled at a rate no faster than about 10° C./minute.

28. The process according to claim 27, wherein the cooling step comprises a combination of cooling and maintaining steps selected from:

(i) cooling the powder from a temperature of greater than about 900° C. to a temperature greater than about 600° C. and maintaining the powder at the temperature of greater than about 600° C.;

(ii) optionally cooling the powder from the temperature greater than about 600° C. to another temperature greater than about 600° C. and maintaining the powder at said temperature; and (iii) optionally repeating step (ii).

29. The process according to claims 27 or 28, wherein at least 50% of the carbon clusters are fully embedded within the ferrous matrix.

30. The process according to claims 27 or 28, wherein at least 70% of the carbon clusters are fully embedded within the ferrous matrix.

31. The process according to claims 27 or 28, wherein the atomized powder is heated to a temperature of greater than 1,000° C.

32. The process according to claims 27 or 28, wherein the powder is cooled to a temperature of not less than about 700° C.

33. The process according to claims 27 or 28, further comprising maintaining the atomized iron powder at a temperature between about 850° C. and greater than about 900° C. or at a temperature greater than about 900° C. for a time sufficient to fully decompose carbides in the iron powder.

34. The process according to claim 28, further comprising the steps of:

(1) cooling the powder from a temperature of greater than about 900° C. to a temperature of below about 600° C.;

(2) re-heating the powder to a temperature of greater than about 700° C.; and (3) cooling the powder from the temperature of greater than about 700° C. to a temperature of greater than 600° C.

35. The process according to claim 34, wherein the powder is re-heated to a temperature greater than 800° C. and cooled from the temperature greater than 800° C. to a temperature of not less than 700° C.

36. The process according to claim 28, further comprising the steps of:

(1) cooling the powder from a temperature of greater than about 900° C. to a temperature of below about 600° C.;

(2) re-heating the powder to a temperature of greater than about 700° C.;

(3) cooling the powder from a temperature of greater than about 700° C. to a temperature of greater than 600° C.;

(4) maintaining the powder at the temperature of greater than about 600° C.; and (5) optionally repeating steps (3) and (4).

37. The process according to claim 36, wherein the powder is re-heated to temperature greater than 800° C. and cooled from the temperature greater than 800° C. to a temperature of not less than 700° C.

38. The process according to claims 27 or 28, wherein the process steps are conducted in an atmosphere that is substantially free of oxygen.

39. The process according to claim 38, wherein the atmosphere is argon, nitrogen, helium, hydrogen or a mixture thereof.

40. The process according to claim 39, wherein the atmosphere contains less than about 10% hydrogen.

41. The process according to claim 38, wherein the atmosphere is a vacuum atmosphere.

42. The process according to claims 27 or 28, wherein the iron-graphite composite powder of step (c) is an iron-graphite composite alloy powder and the liquid iron of step (a) comprises at least one of manganese, nickel, molybdenum, copper, chromium, boron and phosphorus.

43. The process according to claims 27 or 28, wherein the iron-graphite composite powder is an iron-graphite composite powder blend and the iron-graphite composite powder formed in step (c) is blended with at least one elemental alloying element, alloy or compound containing at least one alloying element selected from manganese, nickel, molybdenum, copper, chromium, boron and phosphorus.

44. A sintered article prepared by the process comprising sintering an iron-graphite composite powder, wherein said powder comprises iron-graphite composite powder particles comprising about 2% to about 4.5% by weight carbon and about 0.05% to about 2.5% by weight silicon and having a microstructure comprised of temper carbon clusters embedded in a ferrous matrix, wherein at least 30% of the carbon clusters are fully embedded within the ferrous matrix.

45. A substantially fully dense sintered article prepared by the process comprising sintering an iron-graphite composite powder at a temperature of less than about 1200° C., wherein said powder comprises iron-graphite composite powder particles comprising about 2% to about 4.5% by weight carbon and about 0.05% to about 2.5% by weight silicon and having a microstructure comprised of temper carbon clusters embedded in a ferrous matrix, wherein at least 30% of the carbon clusters are fully embedded within the ferrous matrix.

46. The sintered article according to claim 44, prepared by the process further comprising liquid phase sintering.

47. The sintered article according to any one of claims 44 to 46, wherein the article has a ferrous matrix comprised of ferrite, pearlite, ausferrite, bainite, martensite, austenite, tempered martensite or a mixture thereof.

48. The sintered article according to any one of claims 44 to 46, having a microstructure comprised of carbon clusters embedded in an ausferrite matrix, prepared by a process further comprising:

(a) heating the sintered article to a temperature in the range of about 825° C. to about 950° C.;

(b) cooling the article to a temperature in the range of about 150° C. to about 450° C.; and (c) maintaining the article at the temperature in the range of about 150° C. to about 450° C. for about 15 to about 60 minutes.

49. The sintered article according to any one of claims 44 to 46, comprising at least one of manganese, nickel, molybdenum, copper, chromium, boron and phosphorus.

50. An iron-graphite composite powder comprising composite powder particles comprised of about 2% to about 4.5% by weight carbon and about 0.05% to about 2.5% by weight silicon and having a microstructure comprised of temper carbon clusters embedded in a ferrous matrix, wherein at least 30% of the carbon clusters are fully embedded within the ferrous matrix, wherein said powder is prepared by the process comprising the steps of:

(a) atomizing a carbon- and silicon-containing liquid iron to form an atomized iron powder;

(b) heating the atomized iron powder to a temperature of greater than about 900° C.; and (c) cooling the powder from a temperature of greater than about 900° C. to a temperature of not less than about 700° C.;

wherein the powder is heated to a temperature greater than about 900° C. at a rate sufficient to permit nucleation of the carbon clusters in the core of the powder particles and wherein the powder is cooled at a rate no faster than about 10° C./minute.

51. The iron-graphite composite powder according to claim 50, wherein at least 50% of the carbon clusters are fully embedded within the ferrous matrix.

52. The iron-graphite composite powder according to claim 50, wherein at least 70% of the carbon clusters are fully embedded within the ferrous matrix.

53. The iron-graphite composite powder according to any one of claims 50 to 52, wherein said carbon clusters are embedded in a substantially ferritic matrix.

54. The iron-graphite composite powder according to any one of claims 50 to 52, having a particle size of less than about 300 microns.

55. The iron-graphite composite powder according to any one of claims 50 to 52, comprising about 3% to about 4% by weight carbon and about 0.3% to about 2% by weight silicon.

56. The iron-graphite composite powder according to any one of claims 50 to 52, wherein said particles are comprised of about 3.2% to about 3.7% by weight carbon and about 0.8% to about 1.3% by weight silicon.

57. The iron-graphite composite powder according to any one of claims 50 to 52, comprising about 3.5% to about 3.7% by weight carbon and about 0.8% to about 1.0% by weight silicon.

58. The iron-graphite composite powder according to any one of claims 50 to 52, comprising at least one alloying element.

59. The iron-graphite composite powder according to any one claims 50 to 52, wherein the liquid iron comprises at least one of manganese, nickel, molybdenum, copper, chromium and phosphorus.

60. The iron-graphite composite powder according to any one of claims 50 to 52, wherein said powder is prepared by the process further comprising the step of blending the cooled powder with at least one alloy powder, said alloy comprising an alloying elements selected form the group consisting of manganese, nickel, molybdenum, copper, chromium, boron and phosphorus.

61. A process for preparing an iron-graphite composite powder comprising powder particles comprising about 3.2% to about 3.7% by weight carbon and about 0.8% to about 1.3% by weight silicon and having a microstructure comprised of temper carbon clusters embedded in a ferrous matrix, wherein at least 30% of the carbon clusters are fully embedded within the ferrous matrix, said process comprising the steps of:

(a) atomizing a liquid iron to form an atomized iron powder;

(b) heating the atomized iron powder to a temperature of greater than about 1000° C.; and (c) cooling the powder from a temperature of greater than about 1000° C. to a temperature greater than about 700° C.;

wherein the powder is heated from a temperature of about 650° C. to greater than about 1000° C. at a rate of greater than about 30° C./min, maintained at a temperature between about 850° C. and greater than about 1000° C. or at the temperature greater than about 1000° C. for about 5 minutes to about 16 hours and the powder is cooled at a rate no faster than about 10° C./min.

62. A process of preparing an iron-graphite composite powder, comprising powder particles comprising about 3.2% to about 3.7% by weight carbon and about 0.8% to about 1.3% by weight silicon and having a microstructure comprised of temper carbon clusters embedded in a ferrous matrix, wherein at least 30% of the carbon clusters are fully embedded within the ferrous matrix, said process comprising the steps of:

(a) atomizing a liquid iron to form an atomized iron powder;

(b) heating the atomized iron powder to a temperature of greater than about 1000° C.; and (c) cooling the powder from a temperature of greater than about 1000° C. to a temperature not less than about 700° C.;

wherein the cooling step comprises a combination of cooling and maintaining steps selected from:

(i) cooling the powder from a temperature of greater than about 1000° C. to a temperature not less than about 700° C. and maintaining the powder at the temperature of not less than about 700° C.;

(ii) optionally cooling the powder from the temperature not less than about 700° C. to another temperature not less than about 700° C. and maintaining the powder at said temperature; and (iii) optionally repeating step (ii);

wherein in the powder is heated from a temperature of about 650° C. to greater than about 1000° C. at a rate of greater than about 30° C./min, maintained at a temperature greater than about 1000° C. for about 5 minutes to about 16 hours and cooled at a rate no faster than about 10° C./min.

63. The process according to claims 61 or 62, wherein at least 50% of the carbon clusters are fully embedded within the ferrous matrix.

64. The process according to claims 61 or 62, wherein at least 70% of the carbon clusters are fully embedded within the ferrous matrix.

65. The process according to claims 61 or 62, further comprising the steps of:

(1) cooling the powder from a temperature of greater than about 1000° C. to a temperature of below about 600° C.;

(2) re-heating the powder to a temperature of greater than about 800° C.; and (3) cooling the powder from the temperature of greater than about 800° C. to a temperature of not less than 700° C.

66. The process according to claim 65, further comprising the steps of:

(1) cooling the powder from a temperature of greater than about 1000° C. to a temperature of below about 600° C.;

(2) re-heating the powder to a temperature of greater than about 800° C.; and (3) cooling the powder from a temperature of greater than about 800° C. to a temperature of not less than 700° C.;

(4) maintaining the powder at the temperature of not less than about 700° C.; and (5) optionally repeating steps (3) and (4).

67. The process according to claims 61 or 62, wherein the process steps are conducted in an atmosphere that is substantially free of oxygen.

68. A sintered article prepared by the process comprising sintering the iron-graphite composite powder according to claims 61 or 62.

69. An iron-graphite composite powder comprising composite powder particles comprising about 3.2% to about 3.7% by weight carbon and about 0.8% to about 1.3% by weight silicon and having a microstructure comprised of temper carbon clusters embedded in a ferrous matrix, wherein at least 30% of the carbon clusters are fully embedded within the ferrous matrix, prepared by the process comprising the steps of:

(a) atomizing a carbon- and silicon-containing liquid iron to form an atomized iron powder;

(b) heating the atomized iron powder to a temperature of greater than about 1000° C.; and (c) cooling the powder from a temperature of greater than about 1000° C. to a temperature of not less than about 700° C.;

wherein in the powder is heated from a temperature of about 650° C. to greater than about 1000° C. at a rate of greater than about 30° C./min., maintained at a temperature greater than about 1000° C. for about 5 minutes to about 16 hours then cooled at a rate no faster than about 10° C./min.

70. The iron-graphite composite powder according to claim 69, wherein at least 50% of the carbon clusters are fully embedded within the ferrous matrix.

71. The iron-graphite composite powder according to claim 69, wherein at least 70% of the carbon clusters are fully embedded within the ferrous matrix.

72. The iron-graphite composite powder according to claim 69, comprising about 3.5% to about 3.7% by weight carbon and about 0.8% to about 1.0% by weight silicon.

* * * * *

UNITED STATES PATENT AND TRADEMARK OFFICE

CERTIFICATE OF CORRECTION

PATENT NO. : 6,358,298 B1
DATED : March 19, 2002
INVENTOR(S) : Martin Gagné et al.

It is certified that error appears in the above-identified patent and that said Letters Patent is hereby corrected as shown below:

Title page,
Item [56], References Cited, under FOREIGN PATENT DOCUMENTS,
"JP 11-256277 9/1992" should read -- JP 11-256277 9/1999 --.

Column 1,
Line 46, "Several" should read -- ¶ Several --.

Column 2,
Line 3, "Overcoglu" should read -- ¶ Overcoglu --.

Column 7,
Line 34, "effect" should read -- affect --.

Column 8,
Line 40, "growth" should read -- growth of --.

Column 9,
Line 15, "temperature" should read -- a temperature --; and
Line 55, "growth" should read -- growth of --.

Column 13,
Line 12, "cooled" should read -- be cooled --.

Column 17,
Line 57, "temperature" should read -- a temperature --.

Column 19,
Line 39, "elements" should read -- element --; and "form" should read -- from --.

Column 20,
Line 25, "in" should be deleted"

UNITED STATES PATENT AND TRADEMARK OFFICE

CERTIFICATE OF CORRECTION

PATENT NO. : 6,358,298 B1
DATED : March 19, 2002
INVENTOR(S) : Martin Gagné et al.

It is certified that error appears in the above-identified patent and that said Letters Patent is hereby corrected as shown below:

Column 21,
Line 14, "in" should be deleted.

Signed and Sealed this

Fourth Day of June, 2002

*Attest:*

*Attesting Officer*

JAMES E. ROGAN
*Director of the United States Patent and Trademark Office*